United States Patent [19]

Frick, Jr. et al.

[11] 4,304,564

[45] Dec. 8, 1981

[54] WRINKLE-RESISTANT AND DURABLE-PRESS COTTON-CONTAINING FABRIC BY TREATMENT WITH ACRYLAMIDE AND GLYOXAL

[75] Inventors: John G. Frick, Jr., New Orleans; Robert J. Harper, Jr., Metairie, both of La.

[73] Assignee: The United States of America as represented by the Secretary of Agriculture, Washington, D.C.

[21] Appl. No.: 146,546

[22] Filed: May 5, 1980

[51] Int. Cl.[3] ..... D06M 13/34

[52] U.S. Cl. ..... 8/194; 8/116.4; 8/DIG. 17; 427/302; 427/303; 427/341; 427/342; 427/393.2

[58] Field of Search ..... 8/194, 116.4, DIG. 17; 427/301, 302, 303, 337, 340, 342, 389.9, 393.2, 428, 341, 392

[56] References Cited

U.S. PATENT DOCUMENTS 2,412,832 12/1946 Pfeffer, Jr. et al. ..... 8/115.6
3,102,773 9/1963 Needleman ..... 8/116.3

OTHER PUBLICATIONS

R. D. Mehta, *Textile Research Journal*, "Reactions of Glyoxal with Carbamoylethylated . . . Improved Wrinkle Resistance", (Sep. 1972), pp. 505–511.

S. L. Vail et al., *American Dyestuff Reporter*, "Dihydroxethyleneureas as Wrinkle-Resistance Finishing Agents for Cotton", vol. 50, No. 15, pp. 27–30 (Jun. 1961).

J. B. McKelvey et al., *JAPS*, "Cellulose-d, 1-Butadiene Diepoxide Reactions Catalyzed by Lewis Acids", vol. 9, pp. 191–205 (1965).

Welch et al., American Dyestuff Reporter No. 20, 61–66 (Sep. 27, 1965).

J. G. Frick, *Chem. Tech.* (Feb. 1971), pp. 100–107.

B. A. Doshi et al., *Colourage* (Oct. 1973), pp. 29–34.

Dr. H. Bille et al., Melliand Textilberichte (English Edition) (Feb. 1976), pp. 170–182.

E. F. North, *Textile Chemist and Colorist* 9 (9), (1977), pp. 75–77.

*Primary Examiner*—Michael R. Lusignan
*Assistant Examiner*—Thurman K. Page
*Attorney, Agent, or Firm*—M. Howard Silverstein; David G. McConnell; Raymond C. Von Bodungen

[57] ABSTRACT

Cotton, or other fabric containing cellulose, is treated with acrylamide and a chemical initiator that promotes reaction of acrylamide with cellulose. The fabric, with bound acrylamide, is then treated with glyoxal and an acidic, metal salt catalyst to produce a fabric containing crosslinked cellulose. Thus, the fabric is given wrinkle resistance and durable-press properties by the treatment without using formaldehyde, free or combined, that could be released during treatment or from the treated fabric.

9 Claims, No Drawings

WRINKLE-RESISTANT AND DURABLE-PRESS COTTON-CONTAINING FABRIC BY TREATMENT WITH ACRYLAMIDE AND GLYOXAL

BACKGROUND OF THE INVENTION

1. Field of the Invention

This invention concerns a new treatment of fabric for imparting wrinkle resistance.

2. Description of the Prior Art

Prior finishing treatments to impart wrinkle resistance to cotton or other cellulosic fabric have employed the products from reaction of formaldehyde and an amido compound as finishing agents. These reaction products are methylol amides. Examples of these compounds are dimethylolurea, dimethylolethyleneurea, dihydroxydimethylolethyleneurea, and alkyl dimethylolcarbamates. These agents are applied to cotton, or other cellulose-containing fabric, with an acidic catalyst, and the fabric is heated. On heating the methylol amide reacts with two or more cellulose molecules forming crosslinks. The crosslinked cellulose makes a more resilient fiber than the untreated cellulose. The fiber is then less prone to suffer permanent deformations that appear in the fabric as wrinkles. To serve as a crosslinking agent the finishing agent must possess two or more methylolamide groups in the molecular structure.

The methylolamide crosslinking agents have been quite effective in producing wrinkle resistance. They do, however, suffer from a number of disadvantages. One disadvantage is that the agent and its reaction product on the fabric tend to decompose and release formaldehyde. Formaldehyde is very irritating and even small amounts are objectionable. It is also possible that even a small amount of free formaldehyde may be a hazard.

Another type of crosslinking treatment employs the application of unsaturated amides, such as acrylamide, with chemical or radiation initiation to promote reation of the amide with cellulose. The fabric with bound amide is then treated with formaldehyde to form chemical links between bound amide groups and thereby crosslink the cellulose. This treatment also suffers from the possibility of releasing free formaldehyde.

Formaldehyde-free finishing agents have been proposed before. One class of such agents is prepared from the reaction of glyoxal with amides. Examples of these reaction products are dihydroxyethyleneurea and dihydroxydimethylethyleneurea. These agents are of their nature formaldehyde-free. However, they suffer from lack of effectiveness, that is, they produce less wrinkle resistance, and also have other disadvantages, such as causing discoloration of the fabric. Still other formaldehyde-free crosslinking agents have been proposed. These contain different groups for reaction with cellulose, such as epoxy, chlorohydrin, isocyanate, and hydroxyethylsulfone. All of these have disadvantages that prevented their wide use in commercial practice.

SUMMARY OF THE INVENTION

The purpose of this invention is to provide a treatment for cotton fabric and other fabric composed entirely or in part of cellulose that will render the fabric resistant to wrinkling in use and in laundering and that will consist in applying a finishing agent or agents not made from formaldehyde. Therefore, there will be no release of formaldehyde from the treatment or treated fabric.

The treatment of this invention consists in first applying acrylamide to the fabric with a chemical initiator that will promote reaction of the acrylamide with the cellulose of the fabric on heating. The fabric is then heated to allow this reaction to proceed. After that, glyoxal is applied with an acidic catalyst. The fabric is heated to cause reaction of the glyoxal with the amide groups under the influence of the catalyst. Reaction of glyoxal among two or more amide groups produces crosslinks between cellulose molecules. The cellulosic fabric is thereby given increased resistance to wrinkling without the use of materials that are made from formaldehyde and that could revert to formaldehyde during treatment or on the treated fabric.

DESCRIPTION OF THE PREFERRED EMBODIMENTS

In the application of the invention acrylamide is applied to fabric from an aqueous solution containing about 5–20% acrylamide. Approximately 10% was found to be suitable using the equipment for treating the fabric in our laboratory trials. Although acrylamide is the preferred compound, other unsaturated amides without substituents on the amide group may be used, for example, methacrylamide and crotonamide.

Included in the solution with the acrylamide is an initiator for the reaction between acrylamide and cellulose. This initiator can be an alkaline compound, to promote reaction by an ionic mechanism, or a peroxy compound, to promote reaction by a radical mechanism. If an alkaline compound is used, about 1.0% sodium carbonate is preferred although other alkaline compounds giving a similar degree of alkalinity may be substituted. If a peroxy compound is used as an initiator, 0.01–0.10% ammonium persulfate is used with about 0.02–0.03% preferred. Again, equivalent amounts of other persulfates may be substituted.

The solution of acrylamide and initiator may be applied to fabric by any convenient means. The most common method is by padding, where the fabric is soaked with the solution and passed between squeeze rolls to remove excess solution. In our application by padding, the fabric retained an amount of solution equal to 80–90% of dry fabric weight. Concentration of the solution can be adjusted in the fabric retains more or less of the solution in another application procedure.

After the solution is applied, the fabric is dried. Again, any convenient method may be used. In most instances the fabric will be heated to increase the rate of drying. With persulfate initiators it is advantageous to keep the temperature below 70° C. during drying to prevent premature reaction. With alkaline initiators a greater freedom in temperature is allowed.

After the fabric is dried, it is heated at 120°–160° C. for 3–5 minutes to promote reaction of the acrylamide with the cellulose. With alkaline initiators, heating at 160° C. for 3 minutes is preferred. This heating may be done in ordinary hot air. With persulfate initiators, the heating is preferably done in an inert atmosphere such as nitrogen. Equipment is used in which the fabric is sealed and the surrounding air replaced by nitrogen before heating. Under these conditions it usually takes longer for the fabric to reach the desired temperature. Therefore, a longer period of heating is desirable, for instance 5 minutes at 120° C.

After reaction with acrylamide the fabric is preferably washed to remove any acrylamide not bound to the fabric. However, this washing can be omitted with only a small diminution of the properties to be imparted to the fabric.

The fabric with bound acrylamide is then impregnated with a solution containing 2–20% glyoxal and 0.5–3.0% of an acidic catalyst. In most treatments 5–10% glyoxal is preferred. The catalyst is an acidic salt that will promote reaction of the glyoxal with amide groups but will not damage the fabric. Magnesium chloride in 1.5–2.0% concentration is preferred. Other salts that could be substituted are zinc nitrate, zinc fluoborate, and ammonium chloride.

The fabric is impregnated by padding as before and dried in hot air. The dried fabric is then heated at 150°–160° for 2–5 minutes with 160° C. for 3 minutes preferred. During this period of heating reaction of the glyoxal and formation of crosslinks occurs. It is preferable that the fabric be washed as a final step to remove unreacted agents.

After this treatment the fabric resists wrinkling from random bending in use or in the tumbling during washing and drying.

In the following examples, all percentages are percent by weight. The test methods used to evalulate fabric properties are from those described by the American Association of Textile Chemists and Colorists in the Technical Manual of the AATCC.

EXAMPLE 1

Cotton printcloth was impregnated with an aqueous solution of 12% acrylamide and 1.0% sodium carbonate by wetting the fabric with a solution and then passing the fabric through squeeze rolls to allow the fabric to retain an amount of solution equal to 80–90% of its weight. The fabric was dried at 70° C. for 7 minutes and then heated at 160° C. for 3 minutes. The fabric was divided, and one portion (A) was washed and the second portion (B) was left unwashed. Both portions of the fabric were impregnated as before with an aqueous solution of 10% glyoxal and 1.8% magnesium chloride hexahydrate to give 80–90% weight gain. The fabric was dried at 70° C. for 7 minutes and then heated at 160° C. for 3 minutes. Both portions and a sample of the untreated fabric were washed and tested for durable-press rating to show smoothness after washing and for wrinkle recovery angle to show resistance to wrinkling in use.

TABLE 1

| FABRIC | DURABLE-PRESS RATING | WRINKLE RECOVERY ANGLES (degrees, sum of warp of fill) |
|---|---|---|
| Portion A | 3.4 | 272 |
| Portion B | 3.2 | 261 |
| Untreated | 1.5 | 189 |

EXAMPLE 2

Cotton printcloth was impregnated, as in Example 1, with a solution of 12% acrylamide and 1.0% sodium carbonate. The fabric was dried at 70° C. for 7 minutes and heated at 160° C. for 3 minutes. The fabric was washed and then impregnated with a solution of 5.0% glyoxal and 1.8% magnesium chloride hexahydrate. The impregnated fabric was dried 7 minutes at 70° C. and heated 3 minutes at 160° C. After washing, the treated fabric had a durable-press rating of 3.3 and a wrinkle recovery angle of 280°, sum of warp and fill determinations.

EXAMPLE 3

Cotton printcloth was impregnated by padding through squeeze rolls with a solution of 10% acrylamide and 0.03% ammonium persulfate. The fabric was dried at 60° C. and then placed in a metal foil container. The foil container was flushed with nitrogen and sealed. The fabric was heated 5 minutes at 120° C. in the nitrogen atmosphere and then washed. The washed fabric was padded with a solution of 8.2% glyoxal and 1.8% magnesium chloride hexahydrate, dried, and heated 3 minutes at 160° C. After washing and tumble drying the treated fabric had a durable-press rating of 3.3 and a wrinkle recovery angle of 280°.

EXAMPLE 4

Cotton printcloth was treated as in Example 3 with a solution of 10% acrylamide and 0.02% ammonium persulfate and then, after washing, with a solution of 4.1% glyoxal and 1.8% magnesium chloride hexahydrate. After washing and tumble drying the treated fabric had a durable-press rating of 3.0 and a wrinkle recovery angle of 272°.

We claim:

1. A process for imparting increased wrinkling resistance to fabric without the use of materials made from formaldehyde comprising in combination:

(a) padding an unsaturated amide to fabric with a chemical initiator said chemical initiator selected from the group consisting of about 1% sodium carbonate or 0.01–0.10% ammonium persulfate;

(b) heating the prepared fabric for about 3–5 minutes at 120°–160° C. to promote reaction of the unsaturated amide with cellulose in the fabric;

(c) then, applying glyoxal to the fabric with an acidic catalyst;

(d) heating the fabric to cause reaction of the glyoxal with amide groups under the influence of the catalyst.

2. The process of claim 1 wherein the unsaturated amide applied to the fabric is selected from the group consisting of acrylamide, methacrylamide, and contronamide.

3. The process of claim 1 wherein the acidic catalyst is selected from the group consisting of zinc nitrate, zinc fluoborate, ammonium chloride and magnesium chloride.

4. The process of claim 1 wherein the unsaturated amide is applied to the fabric with the chemical initiator by padding.

5. The process of claim 1 wherein the glyoxal is 5–10%.

6. The process of claim 1 wherein the heating of step (d) is at 150°–160° for 2–5 minutes.

7. The process of claim 2 wherein the unsaturated amide is from an aqueous solution containing about 5–20% acrylamide.

8. The process of claim 3 wherein the catalyst is magnesium chloride of about 1.5–2.0% concentration.

9. The process of claim 1 wherein ammonium persulfate is present in amounts of 0.02–0.03%.

* * * * *